United States Patent [19]

Messineo et al.

[11] 4,440,607

[45] Apr. 3, 1984

[54] METHOD OF PRODUCING TIN PLATE FOR LITHOGRAPHY WITH DIRECT PRINTED ULTRAVIOLET-CURED INKS

[75] Inventors: Salvatore B. Messineo, Upland; Don L. Lasswell, Montclair; Joe Yee, Upland, all of Calif.

[73] Assignee: Kaiser Steel Corporation, Oakland, Calif.

[21] Appl. No.: 383,628

[22] Filed: Jun. 1, 1982

Related U.S. Application Data

[63] Continuation of Ser. No. 228,246, Jan. 26, 1981, abandoned, which is a continuation of Ser. No. 79,836, Sep. 28, 1979, abandoned, which is a continuation-in-part of Ser. No. 971,794, Dec. 12, 1978, abandoned.

[51] Int. Cl.[3] ..... C25D 11/38

[52] U.S. Cl. ..... 204/35 N; 148/6.2; 204/37 T; 204/38 R; 204/40; 204/56 R; 427/334; 427/376.8

[58] Field of Search ..... 204/35 R, 35 N, 37 T, 204/38 R, 40, 56 R; 148/6.2; 427/334, 376.8, 405, 433, 409

[56] References Cited

U.S. PATENT DOCUMENTS

| | | | |
|---|---|---|---|
| 2,606,866 | 8/1952 | Neish | 204/35 X |
| 2,974,091 | 3/1961 | Neish | 204/37 T |
| 3,890,164 | 6/1975 | Harada et al. | 204/37 T X |
| 3,923,471 | 12/1975 | Smith et al. | 204/38 R X |

*Primary Examiner*—Winston A. Douglas
*Assistant Examiner*—William Leader
*Attorney, Agent, or Firm*—James E. Toomey; Robert G. Mukai

[57] ABSTRACT

During production of tin plate on an electrolytic tinning line the tin plated strip is immersed in an aqueous solution of sodium dichromate and thereafter the tin plate surface is oiled with acetyl tributyl citrate. A tin plate surface is thereby provided which can be satisfactorily decorated with ultraviolet-cured direct printed inks.

6 Claims, No Drawings

METHOD OF PRODUCING TIN PLATE FOR LITHOGRAPHY WITH DIRECT PRINTED ULTRAVIOLET-CURED INKS

This application is a continuation of application Ser. No. 228,246, filed 1/26/81 which is a Continuation of 79,836, 09/28/79 which is a continuation-in-part of 971,794, 12/12/78, all of which are abandoned.

SUMMARY OF THE INVENTION

The essential object and advantage of the invention is to provide a method of producing tin plate which can be satisfactorily lithographed with direct printed ultraviolet-cured inks, thereby enabling tin plate processors to convert from the use of solvent based, oven cured direct printing inks and enamels (which are potentially damaging to the atmosphere because of the discharge of solvent vapors into the atmosphere) to ultraviolet light cured inks which are low in solvent content or contain no solvents.

DESCRIPTION OF THE INVENTION

The invention consists of a special chemical treatment and thereafter the application of a specific type of oil to the surface of the tin plate during the production of tin plate on an electrolytic tinning line. The chemical treatment is applied immediately following the reflow section of the tinning line and the oil is applied subsequent to the steps of chemical treatment, rinsing and drying.

From the reflow section of the tinning line the continuous tin plate strip is passed with either one or two passes through an immersion tank containing a solution of sodium dichromate and water having a concentration of sodium dichromate from about 15 grams per liter to about 30 grams per liter and having a pH which has been adjusted to a range of about 2.0 to about 3.0 with chromic acid flakes ($CrO_3$). The optimum concentration has been found to be 18 grams per liter as $Na_2Cr_2O_7$ at a pH range of 2.0–2.5. The temperature of the sodium dichromate solution should be within the limits of 100° F.–180° F., the preferred range being 115° F.–125° F.

From the sodium dichromate immersion tank the continuous tin plate strip is subjected to a succession of immersion tank water rinses and is then passed between squeegee rolls and through a hot air drying zone.

It has been found that substantially improved adhesion of ultraviolet-cured inks can be obtained if relatively small amounts of citric acid are added to the rinse water in the foregoing operation. The amount of citric acid to be added should be sufficient to keep the rinse at pH of about 4 to 7. The best results have been received where the pH has been kept between 5 and 6. Advantageously the citric acid addition is made in the last rinse tank just prior to the squeegee rolls.

After the strip leaves the drying zone the surface of the tin plate is oiled with acetyl tributyl citrate.

The combination of the sodium dichromate chemical treatment and oiling with acetyl tributyl citrate provides a tin plate surface which can be satisfactorily decorated with ultraviolet-cured direct printed inks. The normal cathodic dichromate chemical treatment of tin plate oiled with di-octyl sebacate does not provide the tin plate with surface properties which result in satisfactory adhesion of the ultraviolet-cured coatings in current use. Our invention comprising sodium dichromate treatment and acetyl tributyl citrate oiling results in the production of tin plate surfaces which are chemically and physically compatible with direct printed inks so that the inks upon curing with ultraviolet light will exhibit good adherence to the tin plate surface both before and after the high temperature and high humidity conditions encountered during the processing of food packed in cans made from the tin plate.

In order to extend the storageability time of the tin plate produced by the process of the invention, electric current should be passed between the tin plate surface and steel grids while the continuous tin plate strip is immersed and being passed through the above-described sodium dichromate eletrolytic solution. Polarity of the tin plate surface must be cathodic and the total current should be of such magnitude as to result in a coulomb density of from about 5 to about 45 coulombs per square foot, with 20 coulombs per square foot being the preferred density. Furthermore, the total current may be evenly distributed between one or more passes of the continuous tin plate strip through the dichromate electrolyte, with two passes being preferred.

What is claimed is:

1. The method of treatment of reflowed tin plate to provide the plate with surface properties enabling the adhesion thereto of ultraviolet light cured, low solvent printing inks comprising immersing tin plate in an aqueous solution of sodium dichromate, rinsing and drying the tin plate, and oiling the surface thereof with acetyl tributyl citrate, the improvement which comprises maintaining said solution of sodium dichromate at a concentration within the range of from about 15 grams per liter to about 30 grams per liter and at a pH of from about 2.0 to about 3.0, and applying ultraviolet light curable, low solvent ink to the oiled tinplate.

2. The method of claim 1 wherein said dichromate solution is maintained at a temperature of from about 100° F. to about 180° F.

3. The method of claim 2 comprising passing electric current between the tin plate as a cathode and steel grids while the tin plate is immersed in said solution, said current being of such magnitude in amount as to result in a coulomb density of from about 5 to about 45 coulombs per square foot.

4. The method of claim 1 wherein said tin plate is subjected to water rinse following said dichromate immersion and said rinse water contains citric acid in an amount to maintain said water rinse at pH of about 4 to 7.

5. The method of treatment of tin plate to provide the plate with surface properties enabling the adhesion thereto of ultraviolet light cured, low solvent inks comprising subjecting said tin plate to a reflow step and immersing said reflowed tin plate in an aqueous solution of sodium dichromate, rinsing and drying said reflowed tin plate, and oiling the surface thereof with acetyl tributyl citrate, the improvement which comprises applying said immersion treatment immediately after said reflow step and maintaining said solution of sodium dichromate at a concentration within the range of from about 15 grams per liter to about 30 grams per liter, at a temperature in the range of from about 100° F. to about 180° F. and at a pH of from about 2.0 to about 3.0, and applying ultraviolet light curable, low solvent ink to the oiled tinplate.

6. The method of claim 5 wherein said dichromate solution is maintained at a temperature of from 115° F. to 125° F.

* * * * *